US005988092A

United States Patent [19]

Price

[11] Patent Number: 5,988,092

[45] Date of Patent: Nov. 23, 1999

[54] PADDLE WHEEL BOAT

[76] Inventor: Harold L. Price, 1521 Young St., Henderson, Tex. 75652

[21] Appl. No.: 08/835,877

[22] Filed: Apr. 8, 1997

[51] Int. Cl.[6] ..... B63H 25/06

[52] U.S. Cl. ..... 114/162; 440/91

[58] Field of Search ..... 440/90–92, 62; 114/63, 162, 165

[56] References Cited

U.S. PATENT DOCUMENTS

| | | | |
|---|---|---|---|
| 1,540,259 | 6/1925 | Dravo | 440/90 |
| 2,315,027 | 3/1943 | Svenson | 440/90 |
| 3,371,637 | 3/1968 | Woodall | 440/90 |
| 3,486,253 | 12/1969 | Bruggeman | 440/90 |
| 4,349,340 | 9/1982 | Hoffmann | 114/162 |
| 4,872,413 | 10/1989 | Hebert | 440/92 |

FOREIGN PATENT DOCUMENTS 926224 5/1963 United Kingdom .

*Primary Examiner*—Sherman Basinger
*Attorney, Agent, or Firm*—Robert Nisbett

[57] ABSTRACT

The vessel of this invention has a relatively uniform weight distribution throughout the length of the vessel which maintains a level trim under all operation conditions thereby maximizing the efficiency of the design and operation. This is, in part, accomplished by locating the engine and major transmission drive components inboard of the boat rather than outboard astern, and by locating the operator and the rudder assembly at the bow of the boat. Unique features of the invention include the propulsion and steering systems for a boat consisting of a paddle wheel, a power supply, a clutch, a gear reduction system to transfer and reverse power to the paddle wheel, an optional splash guard mounted between the stern of the boat and the paddle wheel, a frame to attach the propulsion members to the boat and a rudder assembly mounted to the bow of the boat. The paddle wheel can include blades to effect vertical lift secured to angled spokes at an angle radially, inclined or skewed to the axis of rotation of the paddle wheel rather than extending radially from the axis of rotation of the center hubs. The steering system includes the rudder assembly mounted at the bow of the boat and being formed and arranged to pivot freely about a horizontal axis in a vertical direction as well as having a rudder blade which pivots about a vertical axis.

3 Claims, 3 Drawing Sheets

PADDLE WHEEL BOAT

BACKGROUND AND PRIOR ART

This invention relates to the propulsion and steering of paddle wheel boats, more particularly a propulsion and steering unit which may be fitted to any existing craft or to any specially designed craft, to which addition of said unit renders it capable of navigating any and all navigable waterways, as well as, waterways heretofore considered difficult or impossible to navigate, such waterways are shallow and contain logs, stumps, sand-bars, mud-flats, vegetation in the water, growing out of the water and mud and hanging over the waterway or streams, and such waterways comprise swamps and marshes with dense aquatic growth such as moss, cat-tails and saw-grass, or heavy brush growth with low hanging limbs.

No other single craft available today has the capacity to navigate or traverse, with ease and maneuverability, the wide range of terrain which can be traversed by the vessel of this invention. An airboat is capable of traversing shallow, dense aquatic growth marshes. However, due to the excessive height of the propeller cage, they cannot traverse under low hanging limbs. Due to the propulsion by movement of air, the airboat has very low traction and no starting traction on mud-flats, sand-bars etc. Also, in most areas, the excessive noise of the airboat is highly objectionable. Craft, such as go-devils, equipped with long, swiveling drive shaft and a conventional propeller, are capable of traversing fairly shallow water and low hanging limbs, but become fowled in aquatic vegetation such as moss and saw-grass. Existing paddle wheel boat designs experience steering problems when attempting to traverse marshy areas of dense moss and saw-grass growth due to the fact that the steering is mounted at the stern of the boat and is designed to maneuver the stern of the boat to the side to align with the bow of the boat to effect change of direction. Another problem common to present paddle wheel boat design is that the entire weight of the propulsion device is cantilevered behind the stern of the boat causing a severe imbalance of weight distribution toward the stern of the craft. This limits the craft to very slow speeds of operation because, when powered up, the nose of the boat rears upward and the paddle wheel starts to dig in and becomes submerged past the point of effective operation in that an excessive downward thrust is transmitted to the stern of the craft by the upswing of the deeply submerged propelling paddles.

It is therefore an object of this invention to provide a means of traversing all varieties of terrain described herein with a single craft. Moreover, the vessel is capable of traversing such terrain with ease and without damage to elements of the vessel. The vessel easily traverses shallow, heavily vegetated waterways.

It is another object of the invention to provide a highly maneuverable paddle wheel boat. This is accomplished, in part, through the relatively light weight of the unit affording a shallow draft boat, but mainly accomplished by the large bow mounted rudder.

It is another object of the invention to provide a unit with uniform weight distribution of the members to maintain a level trim under all operation conditions thereby maximizing the efficiency of the design.

It is another object of the invention to provide a safe, economical, dependable, low maintenance, quiet and efficient means of traversing difficult, as well as common, waterways for the purposes of recreation, hunting, fishing, exploration, search and rescue operations, or any other effort requiring access to dense, swampy or marshy areas.

U.S. Pat. No. 254,878 to Little, issued Mar. 14, 1882, shows "train boats" which are connected in series with a rear mounted paddle wheel and steam engine and have a pivotable fixed front rudder and side flanges or rudders for navigating low rivers.

U.S. Pat. No. 618,555 to Belz, issued Jan. 31, 1899, shows a pedal operated paddle wheel propulsion system for a boat.

U.S. Pat. No. 2,294,104 to Waddington, issued Aug. 25, 1942, shows an inboard engine operating a dual paddle wheel with springy blades for a hydroplane boat.

U.S. Patent to Thornburg, issued Jun. 28, 1955, shows a rear mounted engine and paddle wheel for a row boat.

U.S. Pat. No. 3,170,437 to Kilmer, issued Feb. 23, 1965, shows a dual paddle wheel system with independent gearing for a pontoon boat.

U.S. Pat. No. 3,922,988 to Caton et. al issued Dec. 2, 1975, shows a detachable steering rudder attached at the rear of a canoe with pontoons.

British Specification 926,224 by Greenfield, shows a rear mounted engine, paddle wheel and steering rudder for a power boat.

BRIEF SUMMARY OF INVENTION

This invention provides a highly maneuverable paddle wheel vessel which can navigate very shallow streams, marshes, and such like. The vessels of this invention can operate at relatively high speeds and yet are practically amphibious. This is accomplished, in part, by having a balanced, relatively light weight unit affording a shallow draft, but is also accomplished by the unique propulsion and steering means.

One embodiment of the invention provides a motor propelled vessel adapted for navigating a relatively shallow stream, marsh and such like, comprising a vessel having a bottom and four outer sides and being designed to float on water having a shallow draft with a bottom having a cross-section which is substantially rectangular, with a stern section and a bow section which connect to at least two substantially vertical sides at the corners of the rectangular cross-section adapted to navigate shallow streams and waterways;

said vessel having a propelling means located at the stern section of said vessel comprising an engine means mounted inboard of said vessel and having a transmission means connecting said engine means to a paddle wheel propulsion means, said paddle wheel propulsion means being located outboard of said vessel near the of said vessel and said engine means being adapted to rotate said paddle wheel propulsion means in the desired direction and at a desired speed by changing the settings of said transmission means and the operating speed of said engine means; and said vessel having a steering means located at the bow section of said vessel with a steering rudder means located outboard of said vessel at the bow section of said vessel and a steering transmission means connecting said steering vane means to a steering controller means located inboard of said vessel at the front of said vessel, and said steering controller means being adapted to be moved to a desired setting to move the steering rudder means to a desired position.

One embodiment of the invention provides a unique propulsion means for a vessel adapted to navigate a shallow stream, marsh and such like comprising:

an engine means mounted inboard of said vessel near the stern section said vessel connected to a transmission means and adapted to transmit movement to said transmission means at selected variable speeds and variable power levels and said transmission means being connected to a paddle wheel drive means located outboard of said vessel near the stern of said vessel and said transmission means adapted to transmit said movement imparted by said engine means in the form of forward or reverse rotation of said paddle wheel drive means and said transmission means adapted to change the speed of said rotation and said paddle wheel driving means having at least one substantially horizontal rotatable shaft bearing at least two hubs at spaced locations on said shaft, and at least a pair of radially extending spokes with one spoke mounted on each hub, with at least one paddle wheel blade being mounted on each pair of spokes mounted on said hubs on said horizontal rotatable shaft, with each pair of spokes being at a spaced location from each other around the circumference of said hubs, with each spoke and paddle wheel blade extending generally radially from the center-line of said horizontal rotatable shaft so that each of said paddle wheel blades when extended downward will extend below the top of said vessel at the stern section and engage the water in which the vessel floats.

One embodiment of the invention provides a unique steering means for a vessel adapted to navigate a shallow stream, marsh and such like comprising:

a rudder support pivotably mounted at the top of said vessel at the bow section of said vessel so that said rudder support is fixed at the back of said rudder support to said vessel and adapted to pivot vertically about a horizontal axis at the rear end of said rudder support and said rudder support having a generally vertical rudder shaft pivotably mounted at the front end of said rudder support, wherein the front of said rudder support extends beyond the bow of said vessel and with said rudder shaft being adapted to pivot about a vertical axis near the front of said rudder support and said rudder shaft having a rudder blade attached to the lower end of said rudder shaft and said rudder shaft and rudder blade being of such length and size that said rudder blade extends downwardly below the bow of said vessel and engages the stream in which the vessel floats and said rudder shaft having a substantially horizontal steering arm attached at a first end of said arm to the upper end of said rudder shaft with a steering cable means attached at the second end of said steering arm and being adapted to move said steering arm about said vertical axis and said steering cable extending to the inboard portion of said vessel and being adapted to be operated to move said steering arm about said vertical axis.

BRIEF DESCRIPTION OF DRAWINGS

These and other objects of the invention will be apparent upon reading the following description and claims in conjunction with viewing the accompanying drawings in which:

DETAILED DESCRIPTION OF INVENTION

Figures 1, 2, 3, 4:
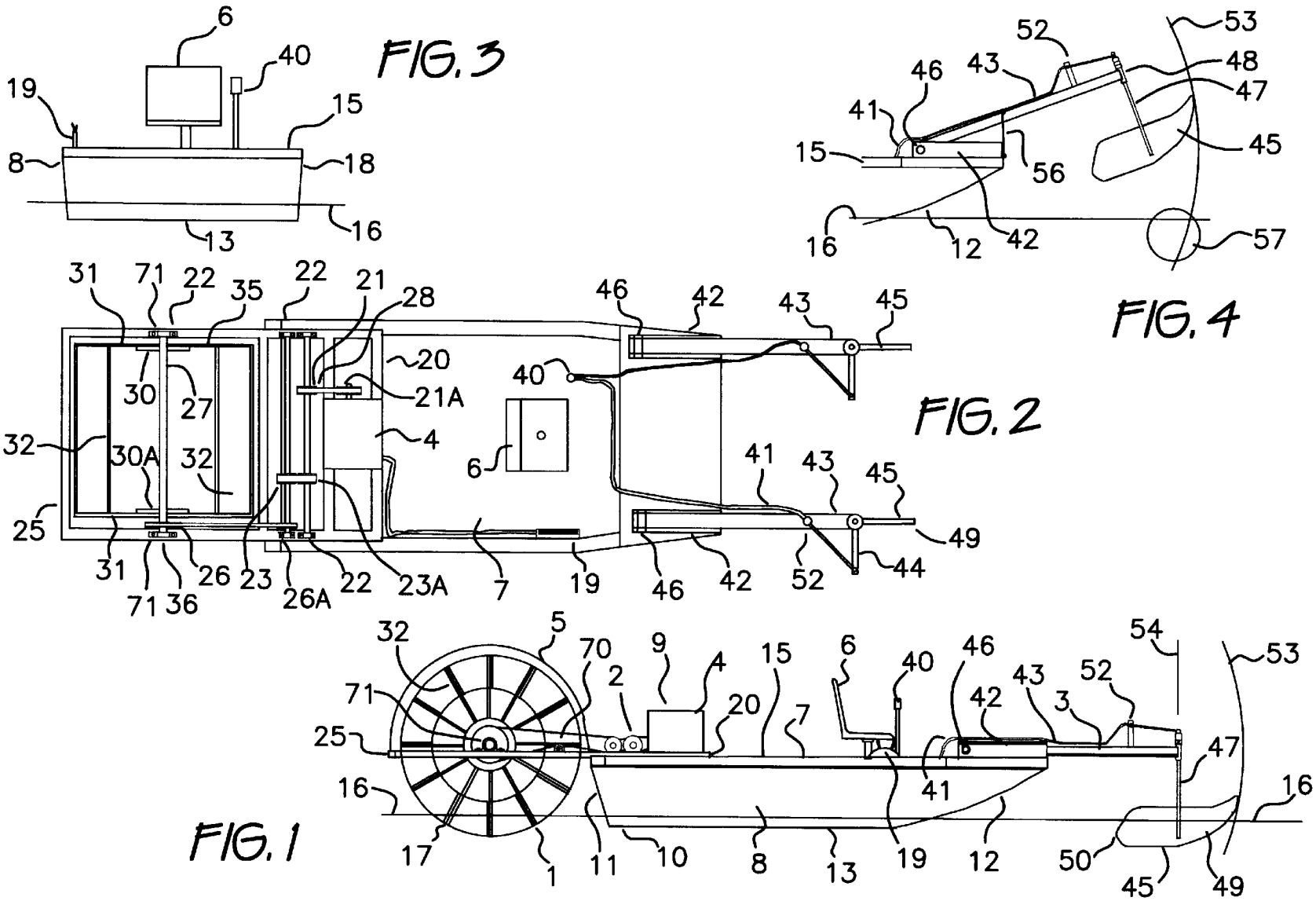
FIG. 1 is a side view of one embodiment of the boat of this invention with one type of paddle wheel means mounted astern and atop a deck, frame, or platform attached to the stern sides and transom of a flat-bottom john boat with the engine means and transmission means mounted atop the platform and fitted to provide improved balance for the boat with the operator near the bow and the steering means mounted atop a platfrom, frame or deck near the bow of the boat.
FIG. 2 is a top view showing the detachable frame, platform or deck to which the paddle wheel means is attached outboard of the craft and on which the engine means and transmission means is mounted inboard of the craft and also showing the operator's seat mounted forward in the craft with steering means attached to a platform or frame at the bow extending forward of the craft with double rudders and having the steering control means and engine and transmission control means within reach of the operator's seat.
FIG. 3 is a partial front view of one embodiment showing the bow of the craft with the operator's seat and controls for the engine and transmission means at one side with the steering control means at the other side of the operator's seat and showing that the bow of the craft is sloped smoothly upward to the top of the gunwales at the side and bow of the craft; the steering means and engine and transmission means are not shown in this view.
FIG. 4 is a partial side view of the bow of the craft showing the front mounted rudder as pivotably attached to the boat and in an upward position as if it had contacted an object in front of the craft at some speed and has been deflected upward at the forward end of the steering means.

The vessel of this invention provides a highly maneuverable paddle wheel boat. This is accomplished, in part, through the relatively light weight of the unit affording a shallow draft boat, but mainly accomplished by the large bow mounted rudder. The bow mounted rudder, to effect a change of direction, utilizes the principle of moving the bow of the boat to one side in the desired direction to realign the bow with the stern in the desired direction of movement, thus allowing the stern to remain in the trail of the boat at all times and allowing the bow and bottom of the boat to make a trail through vegetation and shallow waterways. In a turning maneuver in dense growth, such as saw-grass, the rudder actually utilizes the standing vegetation in making the turn. The vegetation imparts a sideward thrust against the leading side of the rudder, in effect, pushing it in the desired direction. The rudder, being hinged to the boat at the inboard end of the rudder support member and the channel guide, allows up and down motion to an unlimited degree through an arc of long radius which enables it to ride up and over obstructions such as submerged stumps, logs and a shallow bottom without damage to the rudder support, rudder blade and steering mechanism. The prior art utilizes a fixed sleeve on the boat through which passes a swiveling rudder shaft. This configuration does not allow the rudder to ride over any obstacles encountered without manually picking up the rudder shaft.

The vessel of this invention has a relatively uniform weight distribution throughout the length of the vessel which maintains a level trim under all operation conditions thereby maximizing the efficiency of the design and operation. This is, in part, accomplished by locating the engine and major transmission drive components inboard of the boat rather than outboard astern, and by locating the operator and the rudder assembly at the bow of the boat.

The propulsion unit of the vessel can be powered by a small gasoline engine which, similar to a lawn mower engine, is quiet. The low profile of the unit enables it to travel with relative ease under low hanging limbs. The vessel is designed in such a manner that no members, either of the propulsion system nor of the bow mounted, swiveling rudder, become fowled by vegetation. Nor are they damaged by passage over difficult waterways including submerged stumps, logs or shallow bottoms, such as mud-flats or sand-bars. Under certain circumstances and with certain designs, the vessel can actually be amphibious or practically amphibious.

This invention also provides a vessel or craft in which the paddle wheel means can be adjusted upward or downward at the stern of the craft by mounting the paddle wheel on a pivotable frame or platfrom which can be adjusted by the operator using a power adjustment means or some type of manual adjustment. This allows the paddle wheel to be raised or lowered in the water or vegetation to provide more or less traction or clearance as required. For example, at high speeds on open water however deep, the paddle wheel can be raised so that the paddles just barely strike the water surface to give maximum speed and minimum splash. The paddle can be lowered into the water to give maximum driving force for condition which require the maximum forward thrust of the paddles.

Figures 8, 9, 10:
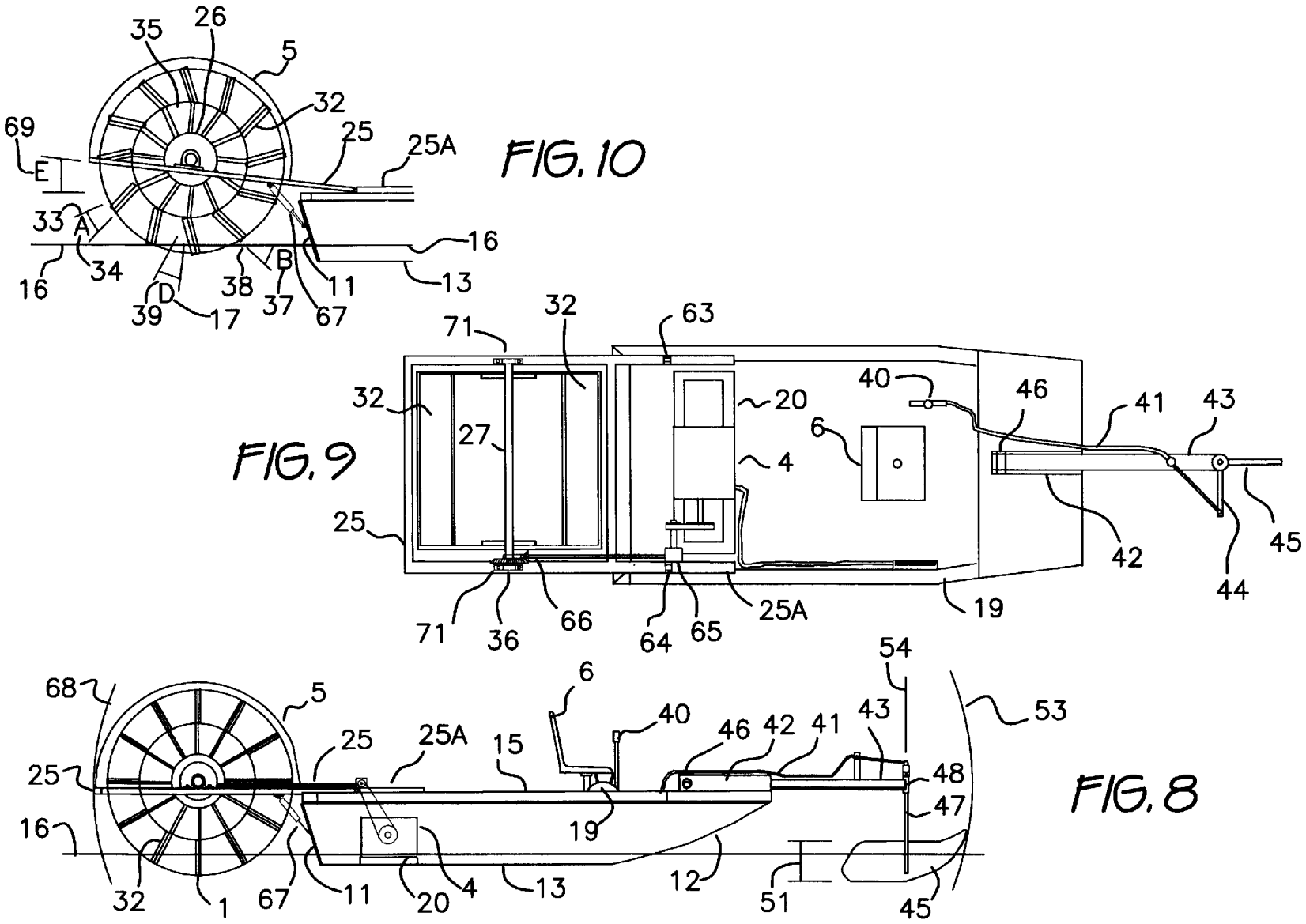
FIG. 8 shows a side view of another embodiment of the craft of this invention showing the paddle wheel means pivotably mounted outboard on a platform attached atop the gunwales or sides and transom of the craft at the stern of the craft with the engine and transmission means mounted inboard near the stern of the craft on a frame located down in the bottom of the craft with a single steering rudder mounted at the bow of the craft near the center line of the craft with the operator's seat located near the front of the craft and the paddle wheel being moveable upward and downward at the stern of the boat by an adjustement means with the paddle wheel means shown in the downward or lowered position relative to the stern of the vessel.
FIG. 9 shows a top view of the embodiment with the pivotably mounted outboard paddle wheel means showing the separate frame for mounting the engine and at least a part of the transmission means with the single steering rudder mounted near the center line of the vessel at the bow of the craft.
FIG. 10 is a partial side view of the stern of the craft showing a pivotably attached paddle wheel means and off-set or angled paddles in an up lifted or raised position relative to the stern of the craft.

Another most effective element in maintaining level trim under power in the design of the paddle wheel. The paddle wheel is inclined or deflected at an angle to the straight radial projection of the support shaft from the hub on which the paddle is mounted. With this inclination the paddle wheel contacts the surface of the water on which the vessel floats at an angle different from the projected angle of the support shaft. This angle of deflection is defined as the angle at which the support shaft is bent at a point between the distal end of the paddle support shaft and the hub on which the shaft is mounted. The point of the bend or deflection is shown as 35 in FIG. 10 but there may be several points of bending in the spoke or a curved section to produce the same angle of deflection. The spokes could also be mounted on the supporting hub tangentially or or in a skewed manner at two points near the outside diameter of the hub so that the base of the spoke does not extend to the center of the hub or to the axis of rotation or the drive shaft of the paddle wheel 27. A straight line or radial projection of a line or of the shaft from the axis of rotation 36 through the most distal point of connection of the shaft to the hub which supports the shaft to the surface of the water is used as a reference for measuring the angle of deflection. For purposes of describing the invention, this angle of deflection between the reference line and plane of the paddle will be designated "A", as shown in FIG. 10 at 34 and 39. For purposes of describing the invention, the angle of contact between the water surface and blade of the paddle wheel will be designated as "B" at 37. The angle of deflection, A, can be varied for different embodiments of the invention. Different angles of contact, B, will result from different angles of deflection, A, of the paddles. Generally, as the angle of deflection "A" increases, the angle of contact "B" will decrease. Different angles of contact, B, between the paddles and the surface of the water will provide different operating characteristics of the propulsion unit. With an increased or positive angle of deflection, A, as shown in FIG. 3, the angle of contact, B, will be reduced, and the paddles will provide a greater lifting force to the stern of the boat upon initial entry of the paddles into the water when operating in a forward or clockwise direction as shown in FIG. 10. Further into the revolution, they will more quickly provide a greater forward push or impetus to propel the boat forward. By the time the paddles leave the water, they have assumed a neutral position and do not impart as much downward thrust to the stern of the craft and as the paddles leave the water. Conventional radially projecting paddles lift and churn the water as they exit the water on each revolution, thereby depressing the stern of the boat and causing an uplift of the bow. The uniform weight distribution and the angled paddles make it possible to turn the paddle wheel at a much higher rate of revolution making available much more thrust and higher speeds than are possible with crafts utilizing current art. The paddles can be angled or deflected from the straight radial projection by several methods such as having a bend in the spokes at a certain point along the length, such as shown at 35, or using a wedge to mount the paddle blade to the spoke but one preferred method is to have a bend in the spoke at a point along its length as shown in FIG. 10. The angle of deflection can be either positive as shown in FIG. 10, or it can be negative which would have the spoke bent in a forward manner as shown at point 39, in FIG. 10, so that the distal end of the spoke and the paddle would lead the straight radial projection of the spoke when the paddle contacts the surface of the water. This would also be the case when the paddle wheel is operated in the reverse or counter-clock wise direction as shown in FIG. 10. When operated in the reverse direction, the deflected paddle wheel tends to pump water under the bottom of the boat thereby providing lift or buoyancy under the boat. This is helpful when the vessel tends to stick to a mud-flat or sand-bar.

Referring to the drawings, one embodiment of the paddle wheel boat is shown from the side in FIG. 1. One type of propulsion means comprising an engine means, a transmission means and a paddle wheel means indicated by 9, is fitted to the boat 7 at the stern of the craft; the propulsion unit comprising, an engine means 4, a supporting frame means 25 which are attached to the boat, a transmission means 2, a paddle wheel means 1, an optional splash guard 5, with a supporting frame means 25 are attached to the boat at the stern, and a steering means 3 is attached at the bow 12; all controlled and operated from an operator's seat 6 which is located forward near the bow of the craft.

Upon choosing the boat to be fitted 7, such as one of those types shown in FIGS. 1, 2, 5, 6, 8 or 9 the frame members 25, for the engine 4, the transmission 2, and paddles wheel 1, are designed to fit the structural portions of the craft. One type of boat that can be used is a flat bottomed craft known as a "john" boat such as a fourteen foot aluminum boat which has a flat bottom with no obstructions. Such a boat may or may not have one or more ribs; longitudinal ribs can run the length of the craft to provide strength to the bottom and some directional stability but such ribs can cause some additional difficulty in steering on sand-bars or mud-flats or if the vessel is caught on an obstruction. Allowances are also made for necessary strength and placement of the transmission and drive means in designing and constructing the frame. The frame can be in one piece as shown in FIGS. 1, 2, 5 and 6 or the frame can be fabricated in two or more sections as shown in FIGS. 8 and 9. The paddle wheel means can be mounted on one frame section and the engine and transmission means mounted on another section of frame. The two section frame also allows for placement of the engine and transmission means either up on the same level as the paddle wheel or lower in the craft and either near the stern or nearer the bow or mid-section of the craft. These variations can be used to fabricate vessels with different balance and different center of gravity characteristics. The different members can also be positioned at different places in the craft to provide space for passengers and cargo. The frame can also be mounted so that the paddle wheel is mounted on a pivotably, adjustable section with another portion of the frame rigidly fixed to the craft. The main support members 25 are fastened to the top of the boat, to the sides or gunwales rearward or at the stern 10 of the boat 7. The supporting frame can be designed so that the engine and transmission sections fasten down in the bottom of the boat at the stern for additional clearances and to provide a lower center of gravity for the vessel with a power transmission section and the paddle wheel support sections passing up and over the transom 11 at the stern of the boat. In some circumstances, the frame may be built into the body of the boat and, in some circumstances, the power transmission means may pass through the transom rather than over the gunwales at the stern. In any event, the frame and the body of the boat must be designed to carry the considerable forces developed by the power system of this invention. The system develops a considerable amount of power, torque and traction, so that the boat and frame members must be designed to handle the power. The transmission means or gear reduction members 2 and the engine 4 fasten to the inboard framing members 20 which, in turn, fasten to or are part of the main framing members 25. In the embodiment shown in FIGS. 8 and 9 the frame for the engine is mounted on the bottom of the craft and the sides, bottom and stern of the craft carry the forces that restrain the engine and transmission. The transmission means can be mounted on the frame with the engine, on a separate platform, on the platform that carries the paddle wheel or parts of the transmission can be mounted in several places. The paddle wheel 1 also fastens to the frame 25 and to the boat 7 at the stern 10 of the boat. As shown in FIGS. 1, 2, 6 and 9, the main shaft 27 of the paddle wheel is mounted on the frame 25 using bearings 71. The paddle wheel 1 can be mounted in a fixed position as shown or it can be made moveable. A hinge assembly can be provided in the frame members 25 along with an adjustment means to allow the paddle wheel 1, to be raised or lowered for adjustment of the operating characteristics of the propulsion unit 9 and of the boat at various speeds and under various conditions. Hinges are shown in FIGS. 8, 9 and 10 at points 63 and 64. An adjusting means, such as shown at 67, can be used to raise or lower the frame 25 and paddle wheel 1 along the arc shown as 68. In FIG. 8 the paddle wheel 1 and frame 25 are shown in a downward position and in FIG. 10, the paddle wheel 1 and frame 25 are shown elevated to an angle "E" at 69. Different types of adjustment means can be used and may be located at different places on the frame to provide different ranges of movement of the frame and paddle wheel. The adjustment means illustrated at 67 can be a pneumatic or hydraulic cylinder attached to the transom 11 and frame 25. Wedges could be placed between the frame 25 and platform 15 and moved forward and rearward to provide the adjustment desired. Likewise, a screw and bolt arrangement could be used to elevate and lower the frame and paddle wheel. Or combinations of these methods could be used. The propulsion means of this invention may be fitted to any existing or specially designed boat to afford a means of traversing various types of waterways, and particularly difficult waterways such as shallow, marshy areas with dense aquatic growth and overhanging limbs. The boat can be a simple flat bottomed boat such as a wooden or metal john boat; it can be a plastic or composition fiber and resin boat; it can be made of foam, wood, metal, plastic, or combinations thereof, the boat can be flat bottomed, round-bottom, v-bottom, square with sharp or rounded corners; it can be a single hull boat or it can have two or more pontoons such as a catamaran type boat; it can be rigid, inflatable or flexible; the stern of the boat can be square, with a perpendicular or angled transom; it can have a rounded or sloped stern; it should have a sloped bow; the sides should not be square to make it easier to propel and easier to turn or easier to slide the craft sideways in shallow water or vegetation.

In operation of the embodiment shown, the engine 4 supplies power to clutch 28, through a series of gear reduction members to the final drive shaft 27 which affords forward motion through impetus furnished by the paddle wheel 1. Different types of engines means and transmission means can be used for various purposes. An engine can be selected from one of several standard types or an engine can be designed especially for this type craft. Likewise, the transmission can be selected from several standard types or it can be designed for the craft. In the embodiments shown, the transmission comprises combinations of belts and pulleys or chains and sprockets sized and located to give the desired speeds and torque desired for the particular application. One embodiment shows the use of bevel gears and drive shafts with belts and pulleys. The parts of the transmission can be open as some are shown or they may be enclosed in housings for safety and protection of the parts, The engine can be selected from various types of gasoline or gas engines; from steam or a compressed gas engine; from electrical engines; from expansion turbines or reciprocating engines; or from combinations of these and other types in view of this disclosure. One preferred embodiment uses a simple gasoline engine. Large, high horse power engines are not required but can be used for some applications. Different types of power transmission and speed control and reversing means can also be used. The simple belt and pulley and chain and sprocket arrangement shown is simple, inexpensive, economical to operate and powerful enough for most conditions. However, with many types of power transmission and speed control available many combinations could be used. One embodiment could use a combined engine and gear box for speed control and reversing direction and a rotary shaft and beveled gears. In such a combination the engine and gear box could be located anywhere along the boat, even in front of the operator's seat and the drive shaft could be made long enough to reach the drive gear located at the paddle wheel. Such a drive shaft could be located in an enclosed housing in the bottom or along one side of the boat. It might have one or more universal joints to provide flexibility and reduce vibration in the system. The engine, or engine and transmission could be located to provide a particular weight distribution for the boat or to provide space for people or gear in certain location of the boat. A separate engine and gear box or transmission unit could be used in the same ways. Power can be transmitted from the engine to the gear box and from the gear box to the drive shaft of the paddle wheel in any one or a combination of several different ways. In addition to the means shown, the drive shaft and bevel gears described above can be used. Hydraulic or pneumatic power transmission means can be used. With electrical motors and regulators, simple electrical wire could be used. With steam or gas turbine systems simple valving can be used. Combinations of these systems can also be used and will be apparent in view of this disclosure.

For the embodiment shown, power transfer and torque increase from the engine 4 to the propelling paddle wheel 1 is effected in the following manner; initially, power is transferred the engine 4 to the primary drive shaft 24 through a v-belt and pulleys 21 and 21A engaged by an idler pulley clutch 28, or other clutching device, manipulated by a cable control at the operator's seat 6. Power is them transferred from primary drive shaft 24 to intermediate drive shaft 29 through belts and pulleys or chain and sprockets as indicated at 23 and 23A. Final power transfer, from intermediate drive shaft 29 to final drive shaft 27 is made through chain and sprockets 26 and 26A. With a long chain or belt drive, it may be desireable to have an idler sprocket or pulley, such as shown at 70, to maintain the desired tension or clearances in the chain or belt. The shafts are supported by pillow block bearings 22 which fasten to framing members 20 and 25. One form of power transfer and torque increase is illustrated in FIG. 2. As is apparent, this could be accomplished in a number of ways without departing from the principles set forth herein. The method set forth is the simplest and more economical and is set forth for illustrative purposes here.

The paddle wheels shown in FIGS. 1, 2, 5, 6, 8, 9 and 10 consists of a circumferentially positioned blade 32 each mounted on a pair of radially extending spokes 31 emanating from a set of hubs 30 and 30A which are secured to the final drive shaft 27 at spaced predetermined location. The final drive sprocket 26 is also secured to the drive shaft 27. The spokes 31 are shown straight in FIGS. 1, 2, 5, 6, 8 and 9 and are shown in FIG. 10 as constructed in such a fashion that they are angled or bent at 35 so that the distal or outward end 17 either leads or trails the projected end 33 of the spoke where the spoke would normally contact the surface of the water 16; this projection is a straight line form the center 36, of the drive shaft 27 and hub 30 or 30A along the portion of the spoke attached to the hub toward the circumference of the paddle wheel to 33. The plane or line of the distal end of the spoke from 35 to 17 is at an angle "A" to the projection of the spoke so that the end of the spoke 17 trails the projected end of the spoke by the distance shown at 34 when the paddle wheel rotates in the forward or clockwise direction. In other words, the distal end of the spoke 17 and the paddle 32 or blade are skewed with reference to the axis of rotation 36 of the paddle wheel 1. Overall paddle wheel diameter, depth of paddles relative to the transom and spoke angle can be individually designed for each type of boat to be fitted and the operating characteristics desired in view of this disclosure. The materials of construction of the paddles will also be determined by the operating conditions.

Referring to FIGS. 1, 2,4 5, 6, 8 and 9, the bow mounted steering means, shown generally at 3, are attached to the bow 12 of the boat 7. A channel guide 42 is rigidly attached to the boat 7 so that rudder support 43 is pivotably attached to the channel guide 42 by a hinge or pin assembly 46; the rudder support 43 can pivot about a horizontal axis 46, also shown as hinge pin 46. The rudder support member 43 is connected to the channel 42 with a hinging pin 46 at the extreme inboard ends of the channel and support member. This allows the entire steering assembly to rotate or pivot upward through an arc from normal running position as shown in FIG. 4, to any position up to perpendicular to normal or even back into the boat. This assembly allows the rudder to ride up and over obstacles such as submerged stumps, floating logs, shallow bottoms or matted saw-grass and moss as depicted in FIG. 4. It is not uncommon, in such terrain, for the rudder to rise vertically in excess of two feet. The rudder assembly can be restrained during operation by a spring or elastic means or by a restraining guard such as shown at 56 in FIG. 4, so that it returns to the operating position when it strikes an object rather that striking the operator. It may be necessary to swing the rudder to a vertical position while manually moving the boat to the side in difficult water ways, to prevent underwater obstacles from impeding movement or when loading the boat on a trailer for transportation. For this function a handle means may be attached to the rudder support. The large sweeping rudder 45 is attached to a rudder shaft 47 which is inserted through, and swivels in, a collar 48 which is rigidly attached to the outboard end of the support member 43. The rudder blade 45 is sloped or angled at the front 49 to facilitate the rudder assembly moving upward when the rudder blade strikes an obstruction. The back of the rudder blade 50 can be shaped to provide the desired characteristics in water or other medium; and the height of the blade 51 can be set to provide adequate weight, strength and surface to give the desired steering characteristics for the medium anticipated. For use in areas with abrasive materials such as mud-flats and sand-bars, it may be desirable for the rudder blade to have a hard metal bottom surface or be made of a heavy metal blade. For encountering certain obstacles it may be desirable to have the bottom of the rudder blade wide enough to strike an obstacle and easily slide up and over the obstacle rather that tend to dig in or cut the obstacle. The rudder blade can be made of wood, plastic, metal or a combination thereof, but it must be strong enough to carry the forces for steering and withstand collisions with obstacles without significant distortion or wearing. Some bracing of the rudder and rudder support may be necessary with certain designs and under severe conditions of operation. The rudder blade should have a length in the range of about 24 inches to 48 inches, preferrably at least about 36 inches, and a height in the range of about 10 inches to 24 inches, preferrably at least 12 inches.

Figures 5, 6, 7:
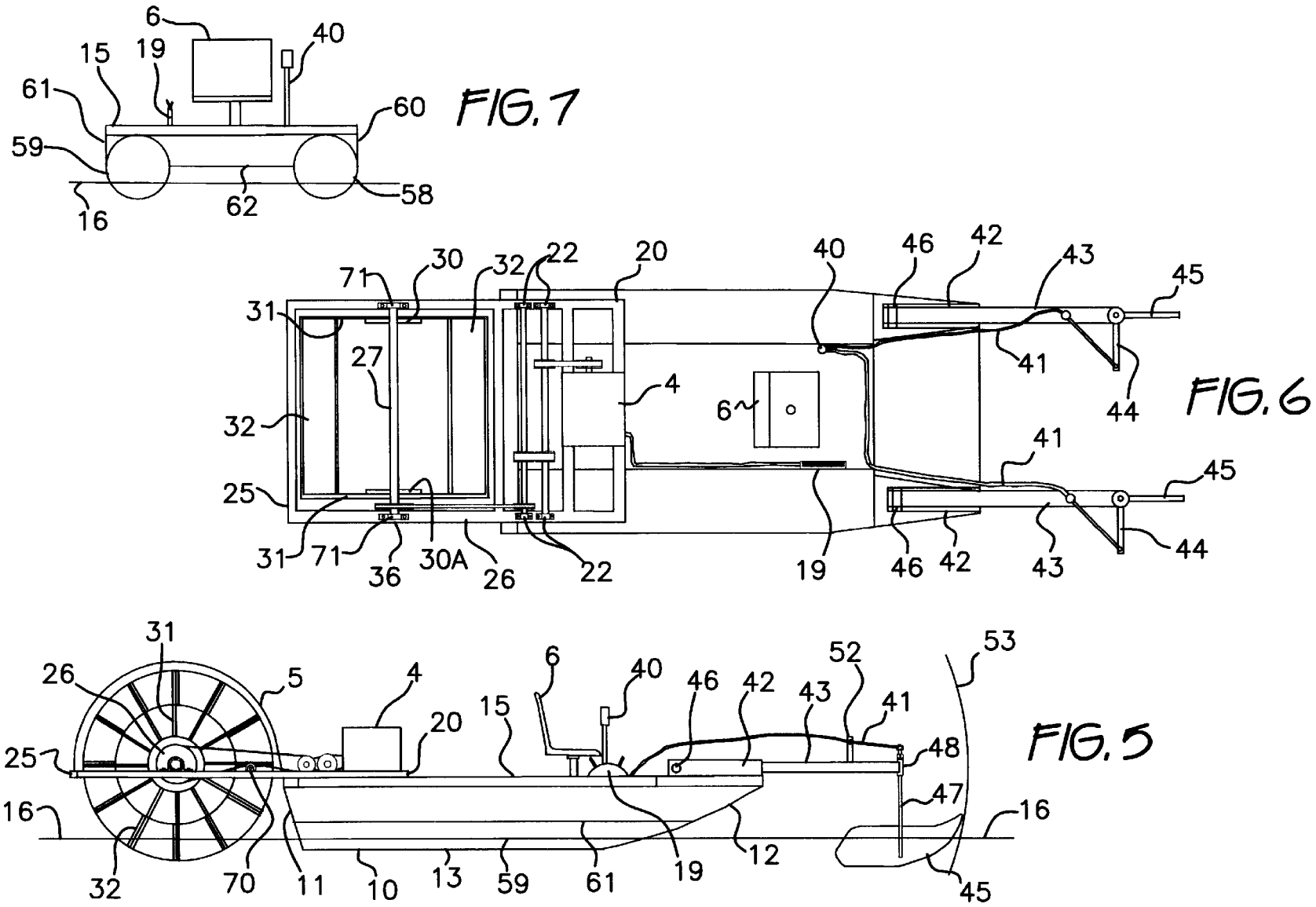
FIG. 5 is a side view of another embodiment of the vessel of this invention showing a pontoon or double hull craft with a substantially rectangular bottom portion between the double hulls which supports the operator's seat and controls with the paddle wheel means, engine means and transmission means and steering means mounted atop a frame, deck or platform attached above the double hulls of the craft.
FIG. 6 is a top view of the pontoon or double hull craft showing the paddle wheel means attached and mounted outboard at the stern of the craft with the engine means and transmission means mounted on the platform inboard at the stern and the steering means attached atop the platform at the bow of the craft with the operator's seat and control means mounted near the bow of the craft.
FIG. 7 is a partial front view showing the location of the operator's seat and control means in the craft without showing the paddle wheel means, the engine and transmission means and the steering means.

For the 7 embodiment shown, the steering arm 44 is constructed with a locking collar 44A attached securely to one end, and a hole for a steering rod connecting pin 41 on the other, the locking collar being placed over and tightened on the protruding end of the rudder shaft 47. The steering rod 41 is attached to the steering stick 40 with a pivoting pin on the other end. The steering stick, throttle and clutch controls are attached to the operator's seat frame 49 and adjusted for maximum performance. The stick steering method, as illustrated in FIG. 4 and FIG. 5 is set forth for illustrative purposes only, as it is readily apparent that numerous other methods of applying impetus to the rudder blade could be utilized without departing from the principles set forth herein. For example, the steering linkage can be the arm and cable arrangement as shown; it can be a series of rigid rods; it can be a wire or cable and housing; it can be a pneumatically or hydraulically operated cylinder; it can be a chain and sprocket arrangement; or it can be a combination of these. Likewise, the operator's controller can be a lever as shown, a steering wheel, a set of foot pedals or some variation thereof. The steering means can be composed of a single rudder assembly as shown or it can be a set of two or more assemblies with one mounted on each side at the front or on each side of the boat or in a spaced arrangement at the front of the boat. Several steering assemblies can be mounted at spaced locations near the bow of the boat and along the side at the front. For amphibious operation, two or more steering assemblies may be desired so that the rudder blades can act more like sled runners. For some conditions some type of restraining means may be necessary to hold each rudder blade in a downward position.

The weight distribution of the unit's design and the innovative angled spoke design of the paddle wheel allow a much higher range of speeds to be applied to the paddle wheel. This in turn furnishes much more thrust than previous designs are capable of. This thrust may be utilized to maintain travel through very dense aquatic growth and to reach higher cruising speeds in open waterways without damage to either the propelling members, the steering members or the boat fittings. When thus underway, the steering members of the unit provide total control and very high maneuverability.

Various advantages, in addition to those already pointed out, and certain obvious modifications to suit a particular purpose may readily appear to those in the art upon studying the foregoing description of the invention and the principles involved. Such obvious modifications are deemed to be a part of this invention, which is to be limited only by the scope of the appended claims, and the reasonably equivalent structures to those defined herein. Unique features of the invention include the propulsion and steering means for a boat consisting of a paddle wheel, a power supply, a clutch, a gear reduction system to transfer power to the paddle wheel, an optional splash guard mounted between the stern of the boat and the paddle wheel, a frame to attach the propulsion members to the boat and a rudder mounted to the bow of the boat. The gear reduction members can be comprised of steel sprockets and chain drive, sized to afford the desired gear ratio. Propulsion means can comprise the power supply, the gear reduction, the splash guard and the paddle wheel fastened to a detachable frame which is bolted to the gunwales of a boat, thereby enabling the entire drive unit to be attached or detached as one unit. The paddle wheel can comprise of a plurality of circumferentially positioned blades each mounted on a pair of spokes emanating from a pair of spaced hubs and secured to a final drive shaft. The paddle wheel can comprise blades secured to angled spokes at an angle skewed to the axis of rotation of the paddle wheel rather than extending radially from the axis of rotation of the center hubs to effect vertical lift. The steering means comprises the rudder mounted at the bow of the boat and being formed and arranged to pivot freely about a horizontal axis in a vertical direction as well as pivot horizontally about a vertical axis. The rudder blade is attached to a round vertical rudder shaft swiveling in a collar rigidly fixed to the outboard end of a hinged support member. Steering means wherein the hinged support member is attached with a hinging pin to and resting in a receiving channel guide which is pivotably and rigidly attached to the bow of the boat, thus allowing free pivoting and vertical movement of the rudder blade.

Referring to FIG. 3, the front of a flat-bottom john boat is shown with an upwardly sloped front or bow and sides 8 and 19 which are slightly inclined with the bottom 13 slightly narrower than the top deck or platform 15. The craft is shown in each of the illustrations with a deck or platform 15 for illustration; such a platform may not be necessary and the structure of the craft may be strong enough and may provide the necessary points of attachment for the equipment described herein. In FIG. 3 the operator's seat 6, engine throttle and gear shift 19 and the steering handle 40 are shown without the front steering means and without the engine and paddle wheel for clarity.

Referring to FIG. 4, the bow 12 of the craft is shown with the guide channel 42 attached at the top of the bow 15 and the rudder support 43 attached to the guide channel by hinge assembly 46. The rudder support is shown in a upward position as if the rudder blade 45 had struck an object in the water 16 such as a log at 57. The entire rudder assembly rises to a height determined by the force of the impact without turning, deflecting or damaging the rudder assembly. In FIG. 4, the rudder assembly is restrained by a spring or elastic means 56 so that the assembly will quickly return to the downward position and will not go all the way back into the craft. The pivot collar 48 and shaft 47 of the rudder assembly are built to take such forces without damage. As shown the steering rod or cable 41 also flexes with movement of the steering assembly. As shown the steering means 41 can be a cable and housing which is fixed to the steering rudder support by attachment means 52 which serves to position arm 44 and pivots the rudder 45 about normally vertical axis 54 but serves to maintain the steering position of the rudder regardless of the position of the rudder support arm. The channel guide 42 serves to give sufficient strength to the rudder support 43 to provide sufficient force for steering the craft in water, vegetation or when obstructions are encountered.

FIGS. 5, 6 and 7 show another embodiment of a craft of this invention having two pontoons or double hull design. As shown in FIG. 7, pontoons 58 and 59 are located along each side of the vessel with a bottom support 62 attached between them. This bottom support is optional and the platform 15 can be used to support the operator, cargo, engine, transmission, and paddle wheel assembly. The bottom support 62 merely provides more space for the operator and cargo. The front of each pontoon is sloped upwardly at the bow 12, as is the bottom support 62 to provide an advantageous planing configuration to the craft and to make it easier to navigate the shallow waterways and vegetation. The operator's seat 6, gear shift and engine throttle 19 and steering control means 40 are positioned near the operator's seat for ease in operating the craft from the one position. In this embodiment, double steering means are used with one steering assembly mounted in front of each pontoon or on each side of the bow at the front of the vessel. The same type of engine means, transmission means and drive means are shown for this embodiment although any type within the invention could be used.

In FIGS. 8, 9 and 10, a variation of the first embodiment is shown. In this embodiment, the engine means 4 is mounted on a separate frame or platform 20 which is located in the bottom of the craft rather than up on the same platform that carries the paddle wheel. The transmission 65 is shown mounted at the side of the craft near the axis of hinges 63 and 64. The hinges 63 and 64 allow the frame 25 to be divided into the main portion 25 which is pivotably mounted and attached to fixed portion 25A. The main portion 25 of the frame is moved or pivoted about the hinges 63 and 64 by an operator or adjustment means 67 which as shown in this embodiment is attached to the lower side of the frame 25 and to the transom 11 of the vessel. Several types of adjustment means can be used, such as a screw operated adjustment means, a wedge operated adjuster, or combination of several types. As shown, the adjustment means can be either hydraulic or pneumatic and would be adjusted by the operator from his seat 6 by some type of operating lever. The operating means for the adjustment means is not shown since several types will be obvious from this description. In FIGS. 8 and 9 the transmission is shown connected to a drive shaft and bevel gears 66 which turn the paddle wheel shaft 27. The drive shaft and gears can be enclosed in housing for safety and maintenance or used open as shown. As shown, a part of the transmission is shown as a belt and pulleys connecting the engine means 4 with transmission means 65 but all of the transmission can be enclosed and either gears, belts and pulleys, chains and sprockets or combinations of these and other elements can be used.

In FIG. 10, an adjustable paddle wheel is shown with the wheel 1 in a upward position with a small portion of the paddles entering the water 16. In addition, the paddle wheel is shown with the paddle wheel spokes bent at point 35 along each spoke in a backward direction at an angle "A" at 34. This bend or deflection changes the angle of the paddle portion 32 contacting and entering the water 16 and leaving the water at 37 at an angle "B". With a forward deflection such as shown, the paddles leave the water at an angle more closely to perpendicular to the water surface 16 and cause less drag, less splash and less uplift. Greater uplift causes the stern of the boat to ride lower in the water which is a hindrance at higher speeds. The paddles could have a negative deflection as shown at 39 with and angle of "D" with the water surface so that the paddles would produce more traction against the water as the paddles enter the water when rotated in a forward direction but this would also dramatically increase the uplift as the paddles leave the water. With the paddle wheel operated in the reverse direction, these characteristics would be reversed.

I claim:

1. A steering means for a vessel adapted to navigate a shallow stream and marsh comprising:

a rudder support arm pivotably mounted at the top of said vessel near the bow section of said vessel so that said rudder support arm is pivotably about a horizontal axis at the rear end of said rudder support arm and said rudder support arm is adapted to pivot upwardly about said horizontal axis and having a generally vertical rudder shaft pivotably mounted at the front end of said rudder support arm, wherein the front of said rudder support arm extends beyond the bow of said vessel and with said rudder shaft being adapted to pivot about a vertical axis near the front of said rudder support arm and said rudder shaft having a rudder blade attached to the lower end of said rudder shaft and said rudder shaft and rudder blade extending downwardly below the bow of said vessel so that the rudder blade is adapted to engage the stream in which the vessel floats and said rudder shaft having a steering arm attached at a first end of said steering arm to the upper end of said rudder shaft with a steering means attached at the second end of said steering arm and being adapted to move said steering arm about said vertical axis and said steering means extending to an inboard portion of said vessel and being adapted to be operated to move said steering arm about said vertical axis and said rudder support arm is pivotably mounted at the rear of said rudder support arm so that the rudder blade and arm assembly can freely pivot upward about said horizontal axis and said steering means having a guide means which maintains said rudder support arm in a fixed orientation relative to the bow of said vessel when the rudder support is in a downward position and allows the rudder support and rudder assembly to freely pivot upward about said horizontal axis at the rear of the rudder support when the rudder strikes an obstruction.

2. A steering means of claim 1 for a vessel adapted to navigate a shallow stream and marsh wherein:

the rudder blade has a length in the range of about 24–48 inches and a height in the range of about 10–24 inches.

3. A steering means of claim 1 for a vessel adapted to navigate a shallow stream and marsh wherein:

said rudder blade has a sloped front and said rudder blade being adapted to slide through water and vegetation in the stream and to allow the rudder assembly to freely ride up and over obstructions in the path of the vessel when the rudder strikes an obstruction.

* * * * *